US011270821B2

(12) United States Patent
Maede et al.

(10) Patent No.: US 11,270,821 B2
(45) Date of Patent: Mar. 8, 2022

(54) SOFT MAGNETIC POWDER, METHOD FOR PRODUCING SAME, AND DUST CORE USING SOFT MAGNETIC POWDER

(71) Applicant: Panasonic Intellectual Property Management Co., Ltd., Osaka (JP)

(72) Inventors: Masato Maede, Kyoto (JP); Kazuto Fukuda, Osaka (JP); Toshiyuki Kojima, Kyoto (JP); Mitsuo Saitoh, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 235 days.

(21) Appl. No.: 16/019,458

(22) Filed: Jun. 26, 2018

(65) Prior Publication Data

US 2019/0013127 A1 Jan. 10, 2019

(30) Foreign Application Priority Data

Jul. 5, 2017 (JP) ..... JP2017-132080
Aug. 8, 2017 (JP) ..... JP2017-153366
Apr. 11, 2018 (JP) ..... JP2018-075902

(51) Int. Cl.
*H01F 1/33* (2006.01)
*H01F 27/255* (2006.01)
(Continued)

(52) U.S. Cl.
CPC ..... *H01F 1/33* (2013.01); *B22F 1/02* (2013.01); *H01F 3/08* (2013.01); *H01F 27/255* (2013.01);
(Continued)

(58) Field of Classification Search
None
See application file for complete search history.

(56) References Cited

U.S. PATENT DOCUMENTS

2006/0027950 A1* 2/2006 Ishitani ..... B22F 1/0088 264/613
2010/0150768 A1 6/2010 Fujita et al.
(Continued)

FOREIGN PATENT DOCUMENTS

CN 101678451 A 3/2010
CN 105917422 A 8/2016
(Continued)

OTHER PUBLICATIONS

English Translation of Chinese Search Report dated Nov. 3, 2020 for the related Chinese Patent Application No. 201810694647.7.
(Continued)

*Primary Examiner* — Xiaowei Su
(74) *Attorney, Agent, or Firm* — McDermott Will & Emery LLP

(57) ABSTRACT

A soft magnetic powder that can exhibit desirable soft magnetic characteristics. A dust core using the soft magnetic powder is also provided. The soft magnetic powder includes: a soft magnetic powder layer of an unoxidized soft magnetic material; a second oxide layer as an oxide with iron or boron residing around the soft magnetic powder layer; and a first oxide layer of an iron oxide residing around the second oxide layer. The first oxide layer and the second oxide layer reside in a region of 20 nm or more and 500 nm or less from a surface of the soft magnetic powder, and are absent in a region of more than 500 nm and 1,600 nm or less from the surface.

14 Claims, 9 Drawing Sheets

(51) Int. Cl.

| | |
|---|---|
| ***B22F 1/02*** | (2006.01) |
| ***H01F 3/08*** | (2006.01) |
| *H01F 1/153* | (2006.01) |
| *B22F 9/04* | (2006.01) |
| *B22F 1/00* | (2022.01) |

(52) U.S. Cl.
CPC ..... *B22F 1/0059* (2013.01); *B22F 2009/048* (2013.01); *B22F 2301/35* (2013.01); *B22F 2302/25* (2013.01); *B22F 2303/15* (2013.01); *B22F 2998/10* (2013.01); *B22F 2999/00* (2013.01); *H01F 1/15308* (2013.01); *H01F 1/15375* (2013.01); *H01F 1/15383* (2013.01)

(56) References Cited

U.S. PATENT DOCUMENTS

| | | | | |
|---|---|---|---|---|
| 2011/0080248 | A1 | 4/2011 | Nishimura | |
| 2013/0255836 | A1* | 10/2013 | Otsuka | H01F 1/15308 148/304 |
| 2016/0336104 | A1* | 11/2016 | Noguchi | B22F 1/0062 |
| 2017/0018343 | A1 | 1/2017 | Nishimura et al. | |
| 2018/0261364 | A1* | 9/2018 | Futamata | H01F 3/08 |
| 2018/0374619 | A1* | 12/2018 | Orimo | H01F 1/342 |

FOREIGN PATENT DOCUMENTS

| | | | |
|---|---|---|---|
| CN | 106104714 | A | 11/2016 |
| CN | 108573786 | A | 9/2018 |
| JP | 1-247555 | A | 10/1989 |
| JP | 5-295402 | A | 11/1993 |
| JP | 11-087123 | A | 3/1999 |
| JP | 2008-297606 | A | 12/2008 |
| JP | 2010-043361 | A | 2/2010 |
| JP | 4944971 | B | 6/2012 |
| JP | 2014-143286 | A | 8/2014 |

OTHER PUBLICATIONS

English Translation of Chinese Search Report dated May 31, 2021 for the related Chinese Patent Application No. 201810694647.7.

* cited by examiner

B

203

202

201

SOFT MAGNETIC POWDER, METHOD FOR PRODUCING SAME, AND DUST CORE USING SOFT MAGNETIC POWDER

TECHNICAL FIELD

The technical field relates to a soft magnetic powder and a method for producing the same, and to a dust core using the soft magnetic powder. Specifically, the present disclosure relates to a soft magnetic powder used for inductor applications such as in choke coils, reactors, and transformers, a method for producing such a soft magnetic powder, and to a dust core using the soft magnetic powder.

BACKGROUND

Recently, there have been rapid advances in the development of electrically powered automobiles, including hybrid electric vehicles (HEVs), plug-in hybrid electric vehicles (PHEVs), and electric vehicles (EVs). For improved fuel economy, there is a demand for making smaller and lighter systems for these vehicles. The growing market for electrically powered automobiles has created a demand for making various electronic components smaller and lighter. There is also an increasing demand for higher performance in soft magnetic powders and in dust cores using soft magnetic powders in applications such as in choke coils, reactors, and transformers.

For miniaturization and lightness, the materials used for soft magnetic powders and dust cores using soft magnetic powders require a high saturation flux density and a small core loss. Soft magnetic powders, and dust cores using soft magnetic powders also require desirable DC bias characteristics.

For example, Japanese Patent Number 4944971 describes a method with which a pulverized powder can achieve a small core loss and desirable DC bias characteristics, the characteristic properties of an Fe-based amorphous alloy.

SUMMARY

FIGS. 1A and 1B show the pulverized powder of an Fe-based amorphous alloy ribbon described in the foregoing patent.

FIG. 1A shows a pulverized powder having a particle size of 50 μm or more. The pulverized powder having a particle size of 50 μm or more is configured from a principal surface 501, which is the principal surface of the amorphous ribbon before pulverization, and a pulverized surface 502, which is a surface that occurs as a result of pulverization. The principal surface 501 does not have any mark on the surface from having been worked. The pulverized surface 502, on the other hand, has clearly observable edges.

FIG. 1B shows a pulverized powder having a particle size of 50 μm or less. The pulverized powder having a particle size of 50 μm or less has a principal surface 503 with marks created after the surface was chipped off by working. No clear edges are observable on a pulverized surface 504.

The principal surface 501, the principal surface 503, the pulverized surface 502, and the pulverized surface 504 undergo oxidation during pulverization and heating, and oxygen enters inside of the pulverized powder. In response, the constituent elements of the Fe-based amorphous alloy ribbon bind to oxygen. This causes the coercive force to increase, and the loss increases in a dust core using the Fe-based amorphous alloy ribbon.

The present disclosure is intended to provide a solution to the foregoing problem of the related art, and it is an object of the present disclosure to provide a soft magnetic powder that can exhibit a high saturation flux density and desirable soft magnetic characteristics while reducing an increase of coercive force. The present disclosure is also intended to provide a dust core using such a soft magnetic powder.

According to an aspect of the disclosure, there is provided a soft magnetic powder that includes:

a soft magnetic powder layer of an unoxidized soft magnetic material;

a second oxide layer as an oxide with iron or boron residing around the soft magnetic powder layer; and a first oxide layer of an iron oxide residing around the second oxide layer, the first oxide layer and the second oxide layer residing in a region of 20 nm or more and 500 nm or less from a surface of the soft magnetic powder, and being absent in a region of more than 500 nm and 1,600 nm or less from the surface.

According to another aspect of the disclosure, there is provided a method for producing a soft magnetic powder, the method including:

pulverizing a soft magnetic composition into a powder; and heating the powder to produce an oxide layer that is present in a region of 20 nm or more and 500 nm or less from a surface of the powder, and that is absent in a region of more than 500 nm or more and 1,600 nm or less from the surface.

The means disclosed in the embodiments can provide a soft magnetic powder that can exhibit a high saturation flux density and desirable soft magnetic characteristics while reducing an increase of coercive force. A dust core using such a soft magnetic powder is also provided.

DESCRIPTION OF EMBODIMENTS

First Embodiment

Production of Soft Magnetic Powder

Figure 1A:
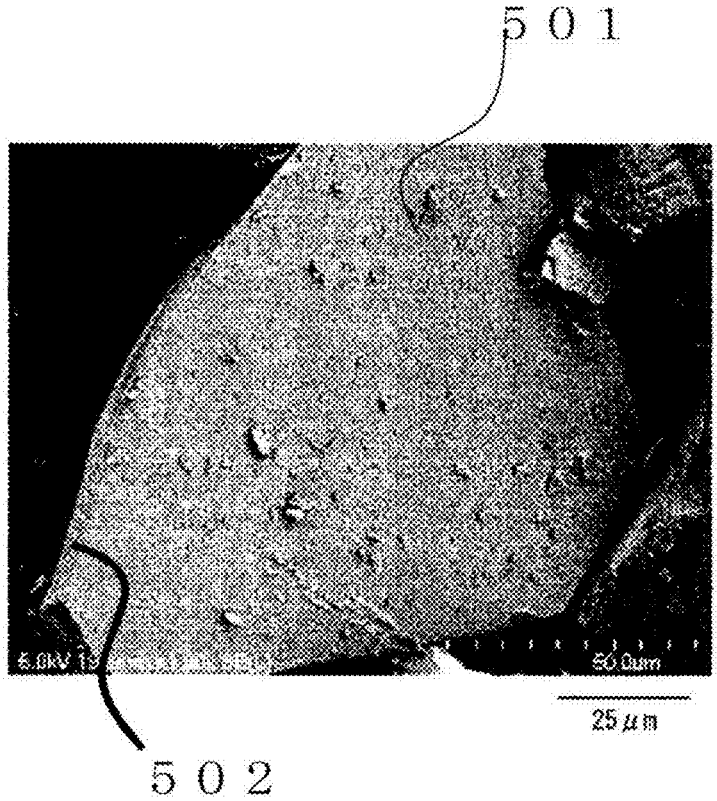
FIG. 1A Related Art
FIG. 1A shows a soft magnetic powder having a particle size of 50 μm or more described in Japanese Patent Number 4944971.
Figure 1B:
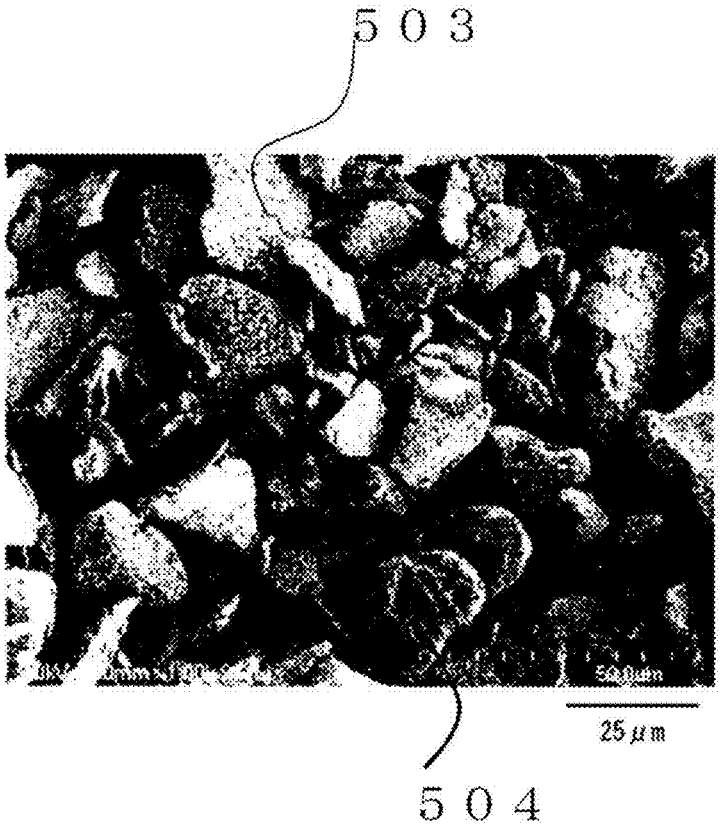
FIG. 1B Related Art
FIG. 1B shows a soft magnetic powder having a particle size of 50 μm or less described in Japanese Patent Number 4944971.

A method for producing a soft magnetic powder of an embodiment is described first.

(1) An alloy composition is melted by means of, for example, high-frequency heating, and an amorphous-phase ribbon or sheet is produced by liquid quenching. A single-roll or twin-roll manufacturing apparatus used for manufacture of, for example, Fe-based amorphous ribbons may be used for the liquid quenching that produces the amorphous-phase ribbon.

(2) The ribbon or sheet is pulverized into a powder. The ribbon or sheet may be pulverized using a common pulverizer. For example, a ball mill, a stamping mill, a planetary mill, a cyclone mill, a jet mill, or a rotary mill may be used. After pulverization, the powder is classified with a sieve, and a soft magnetic powder having a desired particle size distribution is obtained.

(3) The powder pulverized from the ribbon or sheet is then subjected to a heat treatment to remove the internal strain due to pulverization, or to precipitate an αFe crystal phase. A brief heat-treatment under applied pressure using a heat-treatment device, for example, such as a hot press prevents entry of oxygen into the pulverized powder, and the coercive force of the pulverized powder can be reduced. This produces a soft magnetic powder that can exhibit a high saturation flux density and desirable soft magnetic characteristics.

Production of Dust Core (1) For the production of a dust core of the present embodiment, the soft magnetic powder is mixed with a binder having desirable insulation and high heat resistance, such as a phenolic resin and a silicone resin, to produce a granulated powder.

(2) The granulated powder is changed into a mold of the desired shape having high heat resistance and molded under applied pressure to obtain a compact.

(3) Heating at a temperature that cures the binder produces a dust core that can exhibit a high saturation flux density and desirable soft magnetic characteristics.

Total Oxygen Content

The total oxygen content of the soft magnetic powder is measured as follows. First, only a graphite crucible is heated in an inert gas atmosphere (e.g., helium), and the soft magnetic powder is heated to a temperature that melts the soft magnetic powder. In response, the oxygen in the soft magnetic powder reacts with the graphite to form carbon monoxide. Because carbon monoxide actively absorbs infrared rays, it can be detected by an infrared absorption method.

Surface Oxygen Content

The surface oxygen content of the soft magnetic powder is measured as follows. An energy dispersive X-ray spectroscopy (EDX) is used for the measurement. For elemental analysis and composition analysis, the characteristic X-rays resulting from electron bombardment are dispersed in the form of energy.

Example 1 and Comparative Example

An Fe-based amorphous alloy ribbon of the composition Fe73.5-Cu1-Nb3-Si13.5-B9 (atomic %) prepared by single-roll quenching was pulverized using a rotary mill, and an amorphous-phase soft magnetic alloy powder was obtained. The pulverization consisted of 3 minutes of coarse pulverization, and 20 minutes of fine pulverization.

The pulverized powder was subjected to a heat treatment to remove internal strain, and to precipitate an αFe crystalline phase. The heat treatment was performed for Example 1 and Comparative Example. The only difference between Example 1 and Comparative Example is the heat treatment.

Heat Treatment

In Example 1, the heat treatment was performed at 550° C. with a hot press for 20 seconds. In Comparative Example, the heat treatment was performed at 530° C. with a hot-air furnace for 10 minutes.

The total oxygen content, and the surface oxygen content were measured for Example 1 and Comparative Example using the methods described above.

A silicone resin was mixed as a binder, and a granulated powder was produced by granulation. The granulated powder was transferred into a mold and molded under applied pressure to produce a compact. The silicone resin was used in about 3 weight % of the soft magnetic powder.

The compacts of Example 1 and Comparative Example were each measured for core loss at a frequency of 1 MHz and a magnetic flux density of 25 mT, using a B-H analyzer. Samples with a core loss of 1,300 kW/m$^3$ or less were determined as being desirable. This is to ensure that the core loss value is no greater than the core loss values of common metallic materials.

Table 1 shows the total oxygen contents, the surface oxygen contents, and the core losses of Example 1 and Comparative Example.

TABLE 1

| | | | | Thickness of oxide layer | | | Evaluation: |
|---|---|---|---|---|---|---|---|
| | Heat treatment | Total oxygen content (weight %) | Surface oxygen content (weight %) | First oxide layers 101 and 201 (nm) | Second oxide layers 102 and 202 (nm) | Core loss (kW/m$^3$) | Pass for core loss of 1,300 (kW/m$^3$) or less |
| Comparative Example | 530° C. with a hot-air furnace for 10 min | 2.34 | 15.3 | 80 | 1,600 | 1,745 | Fail |
| Example | 550° C. with a hot press for 20 s | 1.01 | 6.81 | 20 | 500 | 1,040 | Pass |

Total Oxygen Content, and Surface Oxygen Content

Figure 2A:
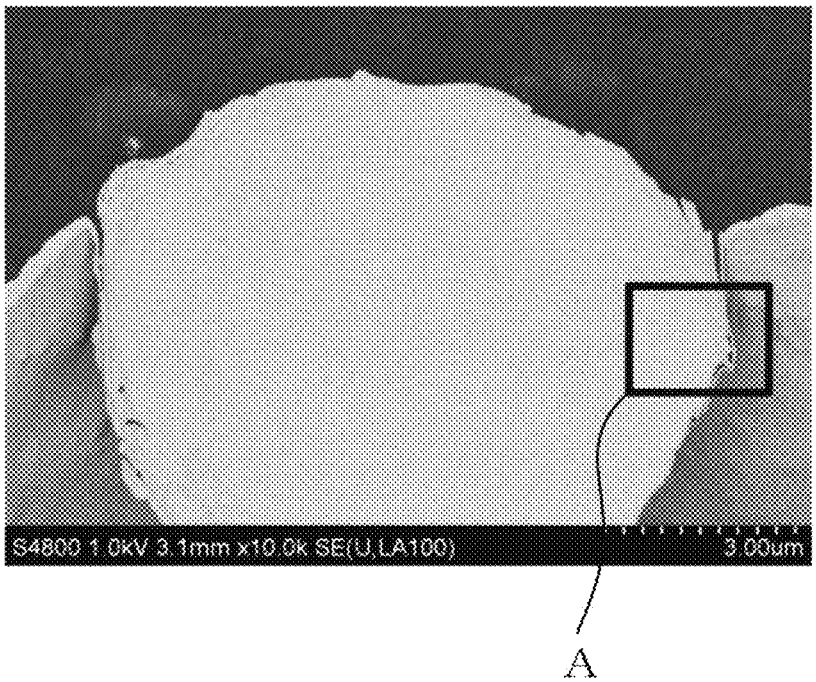
FIG. 2A is an SEM showing a cross section of a soft magnetic powder of an embodiment of the present disclosure.
Figure 2B:
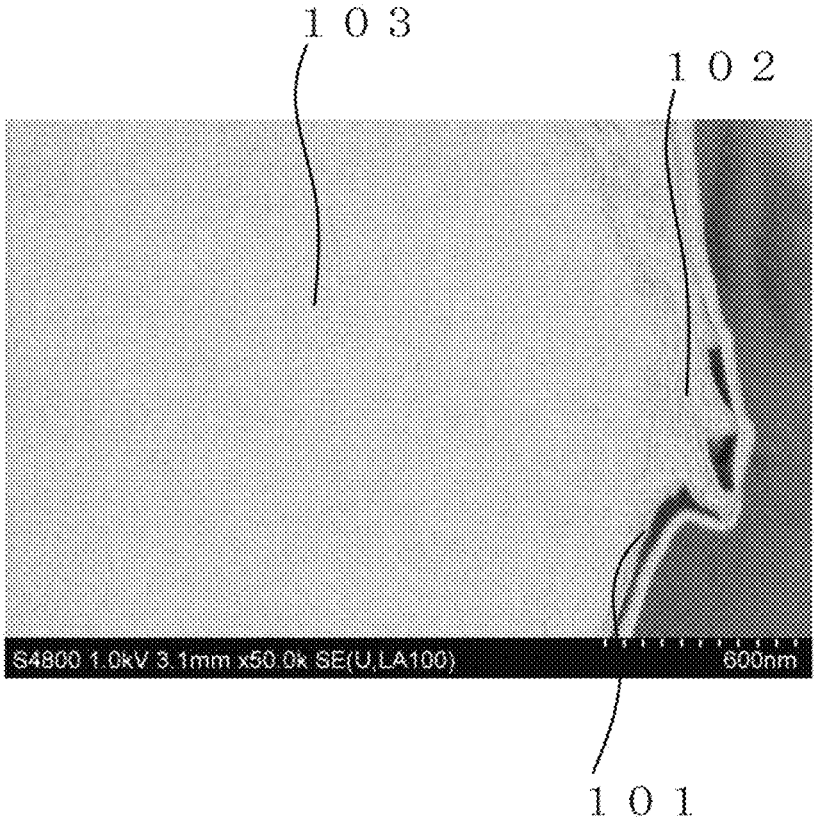
FIG. 2B shows an image magnifying region A of FIG. 2A.

FIG. 2A is an SEM showing a cross section of the soft magnetic powder of Example 1. FIG. 2B shows a view magnifying region A of FIG. 2A. The soft magnetic powder is configured from a first oxide layer 101, a second oxide layer 102, and a soft magnetic powder layer 103. The first oxide layer 101 is a surface layer formed of an iron oxide, which may be FeO, $Fe_2O_3$, or $Fe_3O_4$. The second oxide layer 102 is a layer formed as a result of oxygen entering the powder and binding to an element such as Fe and B, and that resides inside the powder.

The second oxide layer 102 may contain small amounts of boron. Boron may also be absent in the second oxide layer 102. The first oxide layer 101 has a higher oxygen concentration than the second oxide layer 102.

Figure 3A:
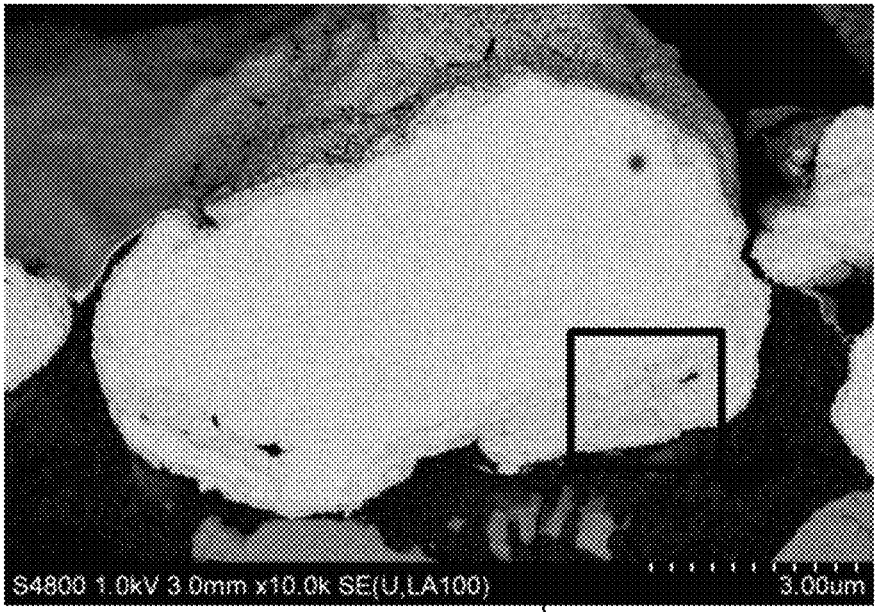
FIG. 3A is an SEM showing a cross section of a soft magnetic powder of a comparative example of an embodiment.
Figure 3B:
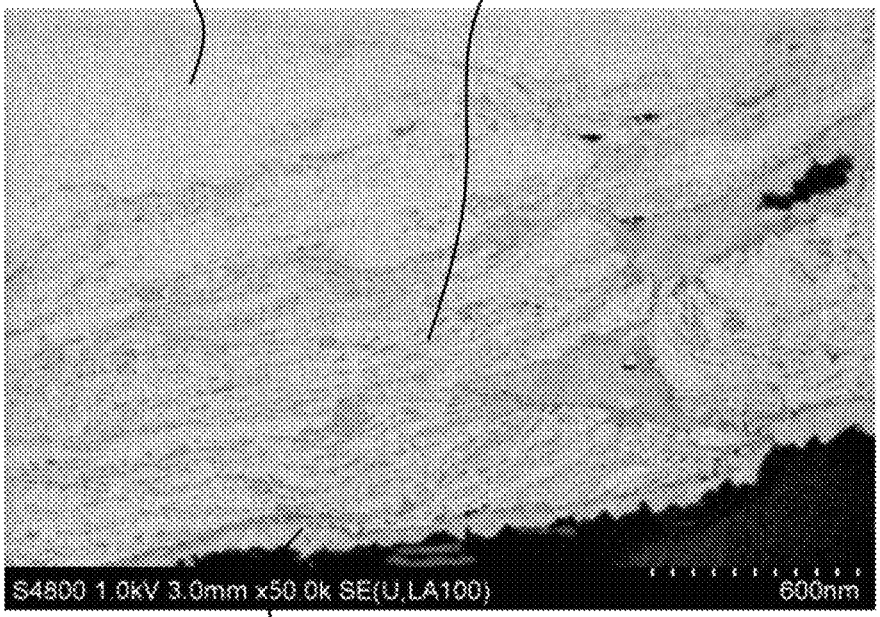
FIG. 3B shows an image magnifying region B of FIG. 3A.

FIG. 3A is an SEM showing a cross section of the soft magnetic powder of Comparative Example. FIG. 3B shows a view magnifying region B of FIG. 3A. The soft magnetic powder is configured from a first oxide layer 201, a second oxide layer 202, and a soft magnetic powder layer 203. The first oxide layer 201 is a surface layer formed of an iron oxide, which may be FeO, $Fe_2O_3$, or $Fe_3O_4$. The second oxide layer 202 is a layer formed as a result of oxygen entering the powder and binding to an element such as Fe and B, and that resides inside the powder.

Table 1 shows the thicknesses of the first oxide layers 101 and 201 and the second oxide layers 102 and 202 measured from FIG. 2B and FIG. 3B. The total oxygen content and the surface oxygen content increase as the first oxide layers 101 and 201 and the second oxide layers 102 and 202 become thicker. It can also be seen that the core loss increases as the first oxide layers 101 and 201 and the second oxide layers 102 and 202 become thicker.

Figure 4:
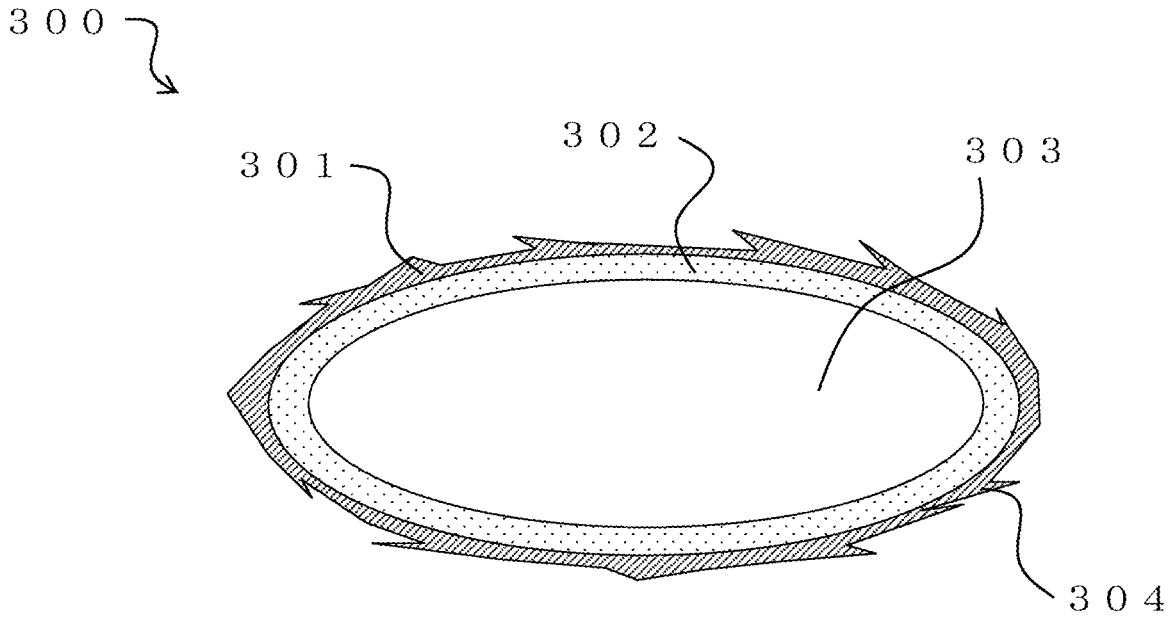
FIG. 4 is a schematic view showing a cross section of a soft magnetic powder of an embodiment.

FIG. 4 shows a schematic view of a cross section of the soft magnetic powder of the embodiment. The pulverized powder 300 of the soft magnetic powder is formed of a first oxide layer 301 residing at the surface, a second oxide layer 302 residing inside of the powder, and a soft magnetic powder layer 303. As can be easily imagined, the soft magnetic powder shows more desirable soft magnetic characteristics as the fraction of the soft magnetic powder layer 303 in the pulverized powder 300 increases.

The oxide layer of Example 1 has a maximum thickness of 520 nm (20 nm for the first oxide layer 301, and 500 nm for the second oxide layer 302). The oxide layer of Comparative Example has a maximum thickness of 1,680 nm (80 nm for the first oxide layer 201, and 1,600 nm for the second oxide layer 202). Because the powders of Example 1 and Comparative Example have about the same particle size, the soft magnetic powder of Example 1 probably has a larger fraction of an unoxidized soft magnetic powder layer and shows more desirable soft magnetic characteristics. The core loss as measured for the compact is smaller in Example 1.

Because of the very short heat-treatment time, the first oxide layer 301 of Example 1 is believed to be a natural oxide layer, and always forms upon contact with the atmosphere.

An aggregate of powders has a space between powders, and the thermal conductivity is low. Accordingly, in a heat treatment using a hot-air furnace, the heat transfers to only powders that occur on the surface and does not sufficiently transfer to inner powders. It is accordingly not possible with a traditional hot-air furnace to remove the internal strain due to pulverization, or to precipitate an αFe crystal phase when the heating time is short.

The soft magnetic powder is therefore preferably one that has the first oxide layer 301 and the second oxide layer 302 in a region of 20 nm or more and 500 nm or less from the surface layer of the powder, and that does not have an oxide layer in a region of more than 500 nm and 1,600 nm or less from the powder surface layer. Here, the oxide layer includes the first oxide layer 301 and the second oxide layer 302.

Preferably, the soft magnetic powder is one that has the oxide layer in a region of 20 nm or more and 100 nm or less from the powder surface layer, and that does not have the oxide layer in a region of 100 nm or more and 1,600 nm or less from the powder surface layer.

Further preferably, the soft magnetic powder is one that has the oxide layer in a region of 20 nm or more and 50 nm or less from the powder surface layer, and that does not have the oxide layer in a region of more than 50 nm and 1,600 nm or less from the powder surface layer.

The electrical resistance near the surface layer of the soft magnetic powder increases when the soft magnetic powder has the second oxide layer 302 in addition to the first oxide layer 301, which is equivalent to a natural oxide layer. In this way, current flows near the surface layer of the soft magnetic powder because of the skin effect at high frequency, and the amount of current can be made smaller, making it possible to decrease the core loss. However, when the second oxide layer 302 is too thick, the fraction of the unoxidized soft magnetic powder layer 303 becomes smaller, and the magnetic characteristics deteriorate. It is therefore preferable to confine the second oxide layer 302 in the foregoing thickness ranges.

In a heat treatment using a hot-air furnace, the heat does not sufficiently transfer to all powders, and the powder temperature does not sufficiently increase during the heat treatment. This necessitates heating the powder for a prolonged time period to remove the internal strain due to pulverization, or to precipitate an αFe crystal phase, with the result that more oxygen enters the soft magnetic powder.

On the other hand, a heat treatment using a hot press heats the powder from above and below and has high thermal conductivity. The heating time is therefore short, and, because there is almost no contact with oxygen, oxygen hardly enters the soft magnetic powder. This makes it possible to obtain a soft magnetic powder that can exhibit a high saturation flux density and desirable soft magnetic characteristics.

The total oxygen content in the magnetic powder is preferably 1.1 weight % or less, more preferably 0.5 weight % or less, further preferably 0.1 weight % or less.

Figure 5A:
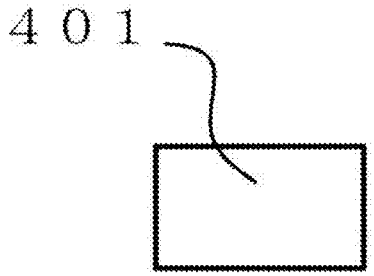
FIGS. 5A and 5B are diagrams representing the steps of producing a soft magnetic powder.
Figure 5B:
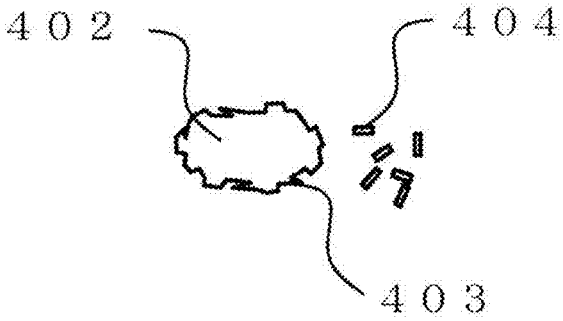

The soft magnetic powder has a pulverization mark 304 on the powder surface, as shown in FIG. 4. The following describes how the pulverization mark occurs, with reference to FIGS. 5A and 5B. Pulverizing the soft magnetic ribbon 401 shown in FIG. 5A cleaves the surface of a powder 402 as illustrated in FIG. 5B, chipping away fine powders 404, and producing a powder 402 with a torn surface having the pulverization mark 403. During the pulverization that produces the powder 402, the pulverization mark 403 occurs as an unoxidized portion of the powder surface, and oxygen enters the powder through the pulverization mark 403 in the pulverization and the heat treatment step, forming the first oxide layer and the second oxide layer.

The pulverization mark 403 on the torn surface is a spike-like structure on the surface of the powder 402. The spike creates an angle of less than 90 degrees with respect to the surface of the powder 402. The angle is 30 to 60 degrees for many of the spikes.

Second Embodiment

Figure 6:
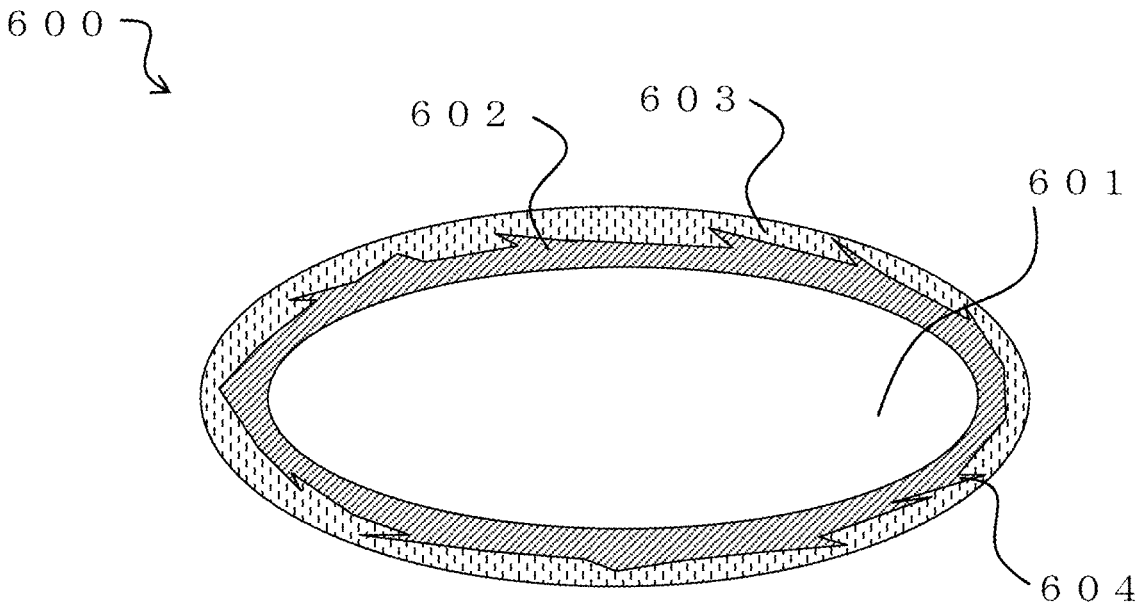
FIG. 6 is a schematic view showing a cross section of a soft magnetic powder of the Second Embodiment of the present disclosure.

FIG. 6 is a schematic view showing a cross section of a soft magnetic powder of the Second Embodiment of the present disclosure.

Structure

A soft magnetic powder 600 is formed of a soft magnetic powder layer 601, a first oxide layer 602 residing on the surface layer of the soft magnetic powder layer 601, a Si concentrated layer 603 residing on the surface layer of the first oxide layer 602 (the outermost layer of the soft magnetic powder), and a pulverization mark 604.

The first oxide layer 602 is an oxide film of, for example, FeO, $Fe_2O_3$, or $Fe_3O_4$, formed by binding of the soft magnetic powder layer 601 with the atmospheric oxygen in a heat treatment. The first oxide layer 602 has a thickness of 20 nm to 500 nm, thicker than the natural oxide film (10 nm to 20 nm). Because the first oxide layer 602 is thin, an increase of coercive force can be reduced.

The Si concentrated layer 603 is a layer of iron and silicon. The Si concentrated layer 603 has a thickness of 700 nm to 1 μm and is formed over the surface layer of the first oxide layer 602 without a break.

When the Si concentrated layer 603 is thin, the soft magnetic powder 600 fails to form a concentration distribution of silicon almost continuously increasing its concentration from a central portion of the soft magnetic powder 600 toward the surface, and the eddy current cannot be reduced. When the Si concentrated layer 603 is thick, the fraction of the soft magnetic powder layer 601 per unit volume of a dust core becomes smaller, and the saturation flux density and magnetic permeability decrease, with the result that desirable magnetic characteristics cannot be obtained. To avoid these drawbacks, the Si concentrated layer 603 should not be overly thin or overly thick.

A method for producing a soft magnetic powder of the Second Embodiment is described below.

Production of Soft Magnetic Powder

A method for producing the soft magnetic powder 600 of the embodiment is described first.

(1) An alloy composition is melted by means of, for example, high-frequency heating, and an amorphous-phase ribbon or sheet is produced by liquid quenching. A single-roll or twin-roll manufacturing apparatus used for manufacture of, for example, Fe-based amorphous ribbons may be used for the liquid quenching that produces the amorphous-phase ribbon.

(2) The ribbon or sheet is pulverized into a powder. The ribbon or sheet may be pulverized using a common pulverizer. For example, a ball mill, a stamping mill, a planetary mill, a cyclone mill, a jet mill, or a rotary mill may be used. After pulverization, the powder is classified with a sieve, and a soft magnetic powder having a desired particle size distribution is obtained.

Figure 7A:
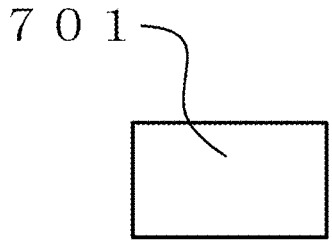
FIGS. 7A and 7B are diagrams representing the steps of producing a soft magnetic powder.
Figure 7B:
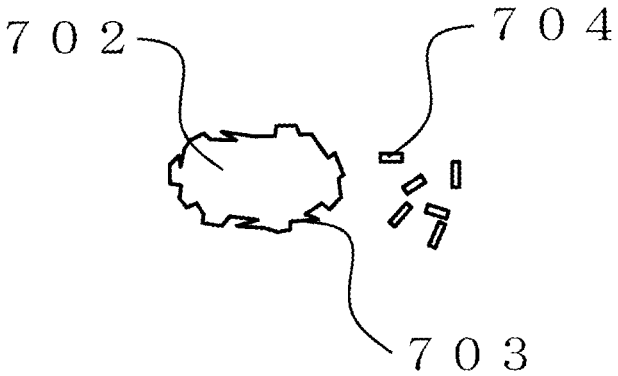

The following describes the mechanism by which the pulverized powder of the present embodiment is produced, with reference to FIGS. 7A and 7B. The soft magnetic ribbon 701 shown in FIG. 7A is pulverized with a pulverizer such as a rotary mill. Pulverizing the soft magnetic ribbon 701 cleaves the surface of a powder 702 as illustrated in FIG. 7B, chipping away fine powders 704, and producing a powder 702 with a surface having a pulverization mark 703. By being cleaved at the surface, the powder 702 has a round shape with no angles. The surface of the fine powder 704 also cleaves by the same mechanism, the fine powder 704 also has a round shape with no angles.

(3) The powder 702 and the fine powder 704 are subjected to a heat treatment to remove the internal strain due to pulverization, or to precipitate an αFe crystal phase. A heat-treatment device, for example, such as a hot-air furnace, a hot press, a lamp, a metal sheathed heater, a ceramic heater, and a rotary kiln may be used.

(4) The Si concentrated layer 603 is formed on the surface layers of the powder 702 and the fine powder 704 after the heat treatment. The Si concentrated layer is formed by, for example, siliconization using a chemical vapor deposition method (CVD method), and a subsequent diffusion process. In this way, the soft magnetic powder can have a smaller eddy current loss, particularly in a high-frequency region. This produces a soft magnetic powder 600 that can exhibit a high saturation flux density and desirable soft magnetic characteristics.

Production of Dust Core (1) For the production of a dust core of the present embodiment, the soft magnetic powder 600 is mixed with a binder having desirable insulation and high heat resistance, such as a phenolic resin and a silicone resin, to produce a granulated powder.

(2) The granulated powder is changed into a mold of the desired shape having high heat resistance and molded under applied pressure to obtain a compact.

(3) Heating at a temperature that cures the binder produces a dust core that can exhibit a high saturation flux density and desirable soft magnetic characteristics.

Example 2 of the Second Embodiment is described below.

Example 2

An Fe-based amorphous alloy ribbon of the composition Fe73.5-Cu1-Nb3-Si13.5-B9 (atomic %) prepared by single-roll quenching was pulverized using a rotary mill, and an amorphous-phase soft magnetic alloy powder was obtained. The pulverization consisted of 3 minutes of coarse pulverization, and 20 minutes of fine pulverization.

The pulverized powder was subjected to a heat treatment to remove the internal strain due to pulverization, and to precipitate an αFe crystalline phase. The heat treatment was performed at 550° C. with a hot press for 20 seconds.

The Si concentrated layer 603 was formed by a CVD method. In a high-temperature environment, a $SiCl_4$ gas is blown against the surface layer of the soft magnetic powder to cause a substitution reaction between Fe and Si in the surface layer of the soft magnetic powder, and the silicon penetrates into the soft magnetic powder. As a result of this chemical reaction, the Si concentrated layer is formed on the soft magnetic powder surface layer. Here, the amount and the rate of siliconization are controlled in forming the Si concentrated layer on the soft magnetic powder surface layer.

Figure 8:
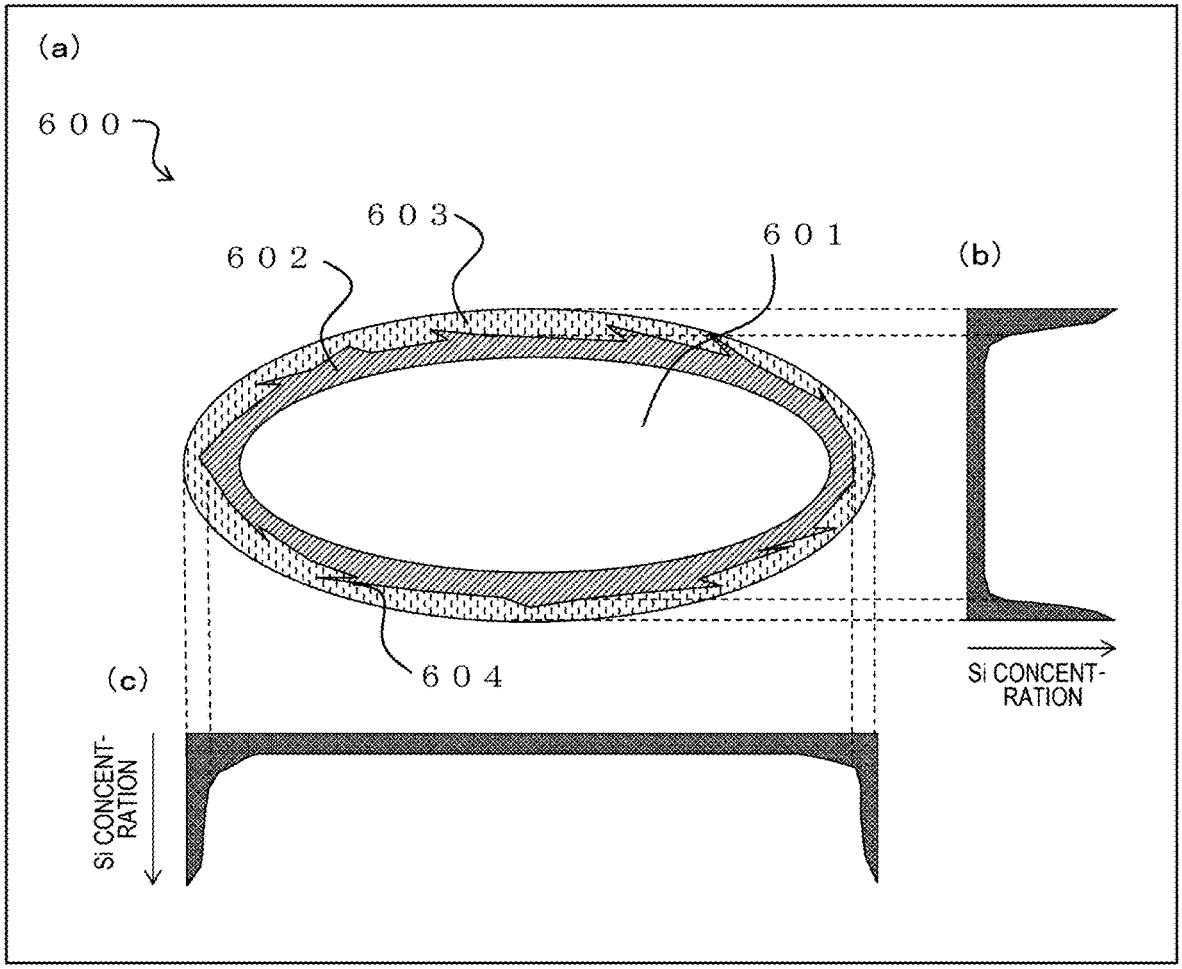
FIG. 8 illustrates diagrams representing a Si concentration in the soft magnetic powder of the Second Embodiment of the present disclosure.

By controlling the temperature and time of high-temperature isothermal soaking in a non-oxidizing atmosphere, it is possible to form a concentration distribution of silicon almost continuously increasing its concentration from a central portion of the soft magnetic powder 600 toward the surface, as shown in FIG. 8.

(a) of FIG. 8 is a schematic view showing a cross section of the soft magnetic powder 600 of the Second Embodiment. (b) of FIG. 8 shows changes in Si concentration in the longest part on the shorter side of the cross section of the soft magnetic powder shown in (a) of FIG. 8. (c) of FIG. 8 shows changes in Si concentration in the longest part on the longer side of the cross section of the soft magnetic powder shown in (a) of FIG. 8.

The highest Si concentration is 14 atomic % to 16.5 atomic %, higher than the Si concentration of the soft magnetic powder layer 601 by an amount of 0.5 atomic % to 3 atomic %. Increasing the Si concentration in the soft magnetic powder 600 increases the electrical resistance of the soft magnetic powder 600, and the eddy current loss become smaller.

The soft magnetic powder 600 produced by forming the Si concentrated layer 603 on the surface layer of the soft magnetic powder 600 was mixed with a binder silicone resin and granulated to make a granulated powder. The granulated powder was transferred into a mold and molded under applied pressure to produce a compact. The silicone resin was used in about 3 weight % of the soft magnetic powder.

The compacts of different samples were each measured for core loss at a frequency of 1 MHz and a magnetic flux density of 25 mT, using a B-H analyzer. Samples with a core loss of 1,300 kW/$m^3$ or less were determined as being desirable. All samples passed the test. A core loss of 1,300 kW/$m^3$ or less was set to ensure that the core loss value is no greater than the core loss values of common metallic materials. It was indeed possible to obtain a dust core having a small loss in a high-frequency region.

Effects

The surface layer portion of the soft magnetic powder 600 has a high Si concentration, and, accordingly, high magnetic permeability, making the eddy current loss smaller. Because the magnetic permeability is different between the central portion and the surface layer portion of the soft magnetic powder 600, the magnetic flux concentrates on the surface layer in an excited state. With the magnetic flux concentrated on the surface layer portion and showing no changes in the inner portion, the eddy current, which generates as a result of a flux density change, occurs only on the surface layer. This makes it possible to reduce the eddy current loss of the soft magnetic powder 600.

Third Embodiment

Figure 9:
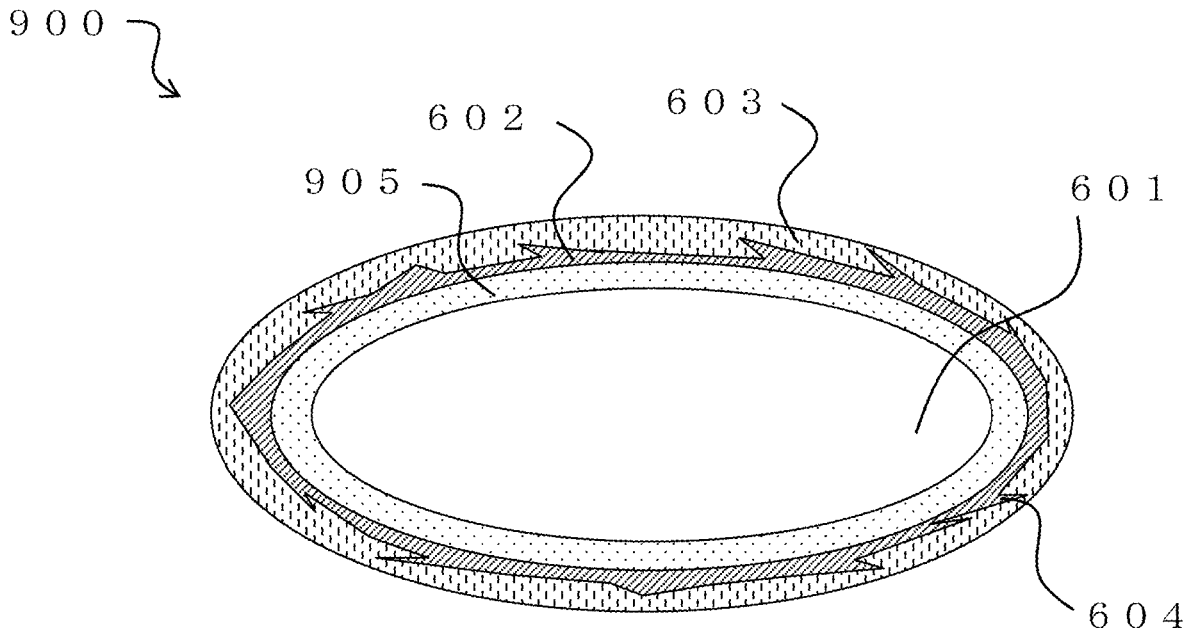
FIG. 9 is a schematic view showing a cross section of a soft magnetic powder of the Third Embodiment of the present disclosure.

FIG. 9 shows a schematic view of a cross section of a soft magnetic powder of the Third Embodiment of the present disclosure. In FIG. 9, the same reference numerals are used to refer to the same members or elements described with reference to FIG. 6, and descriptions of such members or elements are omitted. Anything that is not described is already described in the Second Embodiment.

A soft magnetic powder 900 is formed of a soft magnetic powder layer 601, a second oxide layer 905 residing on the surface layer of the soft magnetic powder layer 601, a first oxide layer 602 residing on the surface layer of the second oxide layer 905, a Si concentrated layer 603 residing on the surface layer of the first oxide layer 602 (the outermost layer of the soft magnetic powder), and a pulverization mark 604.

In the Third Embodiment, the second oxide layer 905 formed inside the soft magnetic powder 900 adds to the configuration of First Embodiment. The first oxide layer 602 is thinner than the second oxide layer 905. The first oxide layer 602 is formed over the surface of the soft magnetic powder 900 without a break, whereas the second oxide layer 905 may be formed only in part between the soft magnetic powder layer 601 and the first oxide layer 602.

The first oxide layer 602 is an oxide film of, for example, FeO, $Fe_2O_3$, or $Fe_3O_4$, formed by binding of the soft magnetic powder layer 601 with the atmospheric oxygen. The first oxide layer 602 has a thickness of 20 nm to 500 nm, thicker than the natural oxide film (10 nm to 20 nm). Because the first oxide layer 602 and the second oxide layer 905 are thin, an increase of coercive force can be reduced.

The second oxide layer 905 is an oxide layer formed inside the soft magnetic powder 900 as a result of binding of iron or boron with the oxygen that has entered through the pulverization mark 604 of the soft magnetic powder 900 in a heat treatment.

Effects

With the second oxide layer 905 formed in addition to the first oxide layer 602, the electrical resistance near the surface layer of the soft magnetic powder 900 increases. Current flows near the surface layer of the soft magnetic powder 900 because of the skin effect at high frequency, and the amount of current can be made smaller. This makes it possible to further reduce the eddy current loss, in addition to the effect that reduces the eddy current loss with the increased Si concentration on the surface layer portion of the soft magnetic powder 900 of the Third Embodiment. Because the first oxide layer 602 and the second oxide layer 905 are thin, an increase of coercive force can be reduced.

Final Note

The soft magnetic powder may be any material, for example, a metal, an alloy, a silicon steel sheet, an amorphous alloy, and a nanocrystalline alloy, provided that it shows soft magnetic properties.

The soft magnetic powder has been described as being a pulverized powder produced by pulverizing a ribbon or a sheet. However, the soft magnetic powder may be an atomized powder produced by using a method such as gas atomization, and water atomization.

The Si concentrated layer 603 may be formed by any method, for example, a plasma CVD method, a thermal CVD method, and a photo-initiated CVD method, provided that it can produce a high Si concentration in the soft magnetic powder surface layer.

The present disclosure enables production of a soft magnetic powder that can exhibit a high saturation flux density and desirable soft magnetic characteristics. A dust core and other such magnetic components using the soft magnetic powder also can be provided.

What is claimed is:

1. A soft magnetic powder comprising:

a soft magnetic powder layer of an unoxidized soft magnetic material;

a second oxide layer as an oxide with iron or boron contacting with the soft magnetic powder layer; and a first oxide layer of an iron oxide contacting with the second oxide layer, wherein:

the first oxide layer and the second oxide layer reside in a region of 20 nm or more and 500 nm or less from a surface of the soft magnetic powder, and are absent in a region of more than 500 nm and 1,600 nm or less from the surface, and the first oxide layer is a layer of iron oxide and does not contain Al and Cr.

2. The soft magnetic powder according to claim 1, wherein the first oxide layer and the second oxide layer reside in a region of 20 nm or more and 100 nm or less from the surface, and are absent in a region of more than 100 nm and 1,600 nm or less from the surface.

3. The soft magnetic powder according to claim 1, wherein the first oxide layer and the second oxide layer reside in a region of 20 nm or more and 50 nm or less from the surface, and are absent in a region of more than 50 nm and 1,600 nm or less from the surface.

4. A dust core comprising the soft magnetic powder of claim 1, and a binder.

5. A soft magnetic powder comprising:

a soft magnetic powder layer of an unoxidized soft magnetic material;

a second oxide layer as an oxide with iron or boron residing around the soft magnetic powder layer; and a first oxide layer of an iron oxide residing around the second oxide layer, wherein:

the first oxide layer and the second oxide layer reside in a region of 20 nm or more and 500 nm or less from a surface of the soft magnetic powder, and are absent in a region of more than 500 nm and 1,600 nm or less from the surface, the first oxide layer has a spiked pulverization mark on a powder surface layer, and an angle formed by the spiked pulverization mark with respect to the powder surface is 30 to 60 degrees.

6. A soft magnetic powder comprising:

a soft magnetic powder layer of an unoxidized soft magnetic material;

an oxide layer of an iron oxide residing around the soft magnetic powder layer; and a silicon containing layer covering a surface layer of the oxide layer without a break, the soft magnetic powder having a silicon concentration that continuously increases from a central portion of the soft magnetic powder layer toward a surface layer of the soft magnetic powder layer, and the oxide layer being configured from a first oxide layer residing on the surface-layer side, and a second oxide layer of an oxide with iron or boron residing on the soft-magnetic-powder-layer side.

7. The soft magnetic powder according to claim 6, wherein the oxide layer has a thickness of 20 nm to 500 nm.

8. The soft magnetic powder according to claim 6, wherein the silicon containing layer has a thickness of 200 nm to 1 μm.

9. The soft magnetic powder according to claim 6, wherein the oxide layer has a thickness of 20 nm to 500 nm.

10. A dust core comprising the soft magnetic powder of claim 6 and a binder.

11. A soft magnetic powder comprising:

a soft magnetic powder layer of an unoxidized soft magnetic material;

an oxide layer of an iron oxide residing around the soft magnetic powder layer; and a silicon containing layer covering a surface layer of the oxide layer without a break, wherein:

the soft magnetic powder has a silicon concentration that continuously increases from a central portion of the soft magnetic powder layer toward a surface layer of the soft magnetic powder layer, and the silicon containing layer has a silicon concentration that is 0.5 atomic % to 3 atomic % higher than the silicon concentration of the soft magnetic powder layer.

12. A soft magnetic powder comprising:

a soft magnetic powder layer of an unoxidized soft magnetic material;

a second oxide layer which is an oxide containing boron and resides around the soft magnetic powder layer; and a first oxide layer of an iron oxide residing around the second oxide layer, wherein:

the first oxide layer and the second oxide layer reside in a region of 20 nm or more and 500 nm or less from a surface of the soft magnetic powder, and are absent in a region of more than 500 nm and 1,600 nm or less from the surface.

13. The soft magnetic powder according to claim 12, wherein the iron oxide is FeO, $Fe_2O_3$, or $Fe_3O_4$.

14. A soft magnetic powder comprising:

a soft magnetic powder layer of an unoxidized soft magnetic material;

a second oxide layer as an oxide with iron or boron residing around the soft magnetic powder layer; and a first oxide layer of an iron oxide residing around the second oxide layer, wherein:

the first oxide layer and the second oxide layer reside in a region of 20 nm or more and 500 nm or less from a surface of the soft magnetic powder, and are absent in a region of more than 500 nm and 1,600 nm or less from the surface, and a total amount of surface oxygen of the first oxide layer and the second oxide layer is 6.81% by weight.

* * * * *